US010606183B2

(12) United States Patent
Shibata et al.

(10) Patent No.: US 10,606,183 B2
(45) Date of Patent: Mar. 31, 2020

(54) ELECTROSTATIC LATENT IMAGE DEVELOPING TONER AND IMAGE FORMING METHOD

(71) Applicant: Konica Minolta, Inc., Tokyo (JP)

(72) Inventors: Koji Shibata, Hachioji (JP); Takuya Takahashi, Higashimurayama (JP); Futoshi Kadonome, Sagamihara (JP); Shinya Obara, Fuchu (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/269,020

(22) Filed: Feb. 6, 2019

(65) Prior Publication Data

US 2019/0278192 A1 Sep. 12, 2019

(30) Foreign Application Priority Data

Mar. 7, 2018 (JP) ..... 2018-040288

(51) Int. Cl.

| | |
|---|---|
| ***G03G 9/08*** | (2006.01) |
| ***G03G 9/097*** | (2006.01) |
| *G03G 9/107* | (2006.01) |
| *G03G 9/09* | (2006.01) |
| *G03G 9/087* | (2006.01) |
| *G03G 9/113* | (2006.01) |

(52) U.S. Cl.

CPC ..... *G03G 9/09716* (2013.01); *G03G 9/0825* (2013.01); *G03G 9/09708* (2013.01); *G03G 9/09791* (2013.01); *G03G 9/0804* (2013.01); *G03G 9/08711* (2013.01); *G03G 9/0918* (2013.01); *G03G 9/1075* (2013.01); *G03G 9/1132* (2013.01)

(58) Field of Classification Search

None

See application file for complete search history.

(56) References Cited

U.S. PATENT DOCUMENTS

| | | | | |
|---|---|---|---|---|
| 5,707,770 | A * | 1/1998 | Tanikawa | G03G 9/09716 430/108.3 |
| 2014/0220488 | A1* | 8/2014 | Hosoya | G03G 13/08 430/119.71 |
| 2016/0048089 | A1* | 2/2016 | Nakatani | G03G 9/09708 430/108.4 |

FOREIGN PATENT DOCUMENTS

JP 2014-228763 A 12/2014

OTHER PUBLICATIONS

Diamond, A.S., ed., Handbook of Imaging Materials, Marcel Dekker, NY (1991), pp. 160-161. (Year: 1991).*

* cited by examiner

*Primary Examiner* — Mark A Chapman

(74) *Attorney, Agent, or Firm* — Lucas & Mercanti, LLP

(57) ABSTRACT

Provided is an electrostatic latent image developing toner including toner mother particles having an external additive on a surface of the toner mother particles, wherein the external additive contains inorganic particles and aliphatic acid metal salt particles; the inorganic particles have a number average particle diameter in the range of 10 to 50 nm, and have a Mohs hardness of 8 or more; and the aliphatic acid metal salt particles have a number average particle diameter in the range of 0.4 to 2.0 μm.

6 Claims, 1 Drawing Sheet

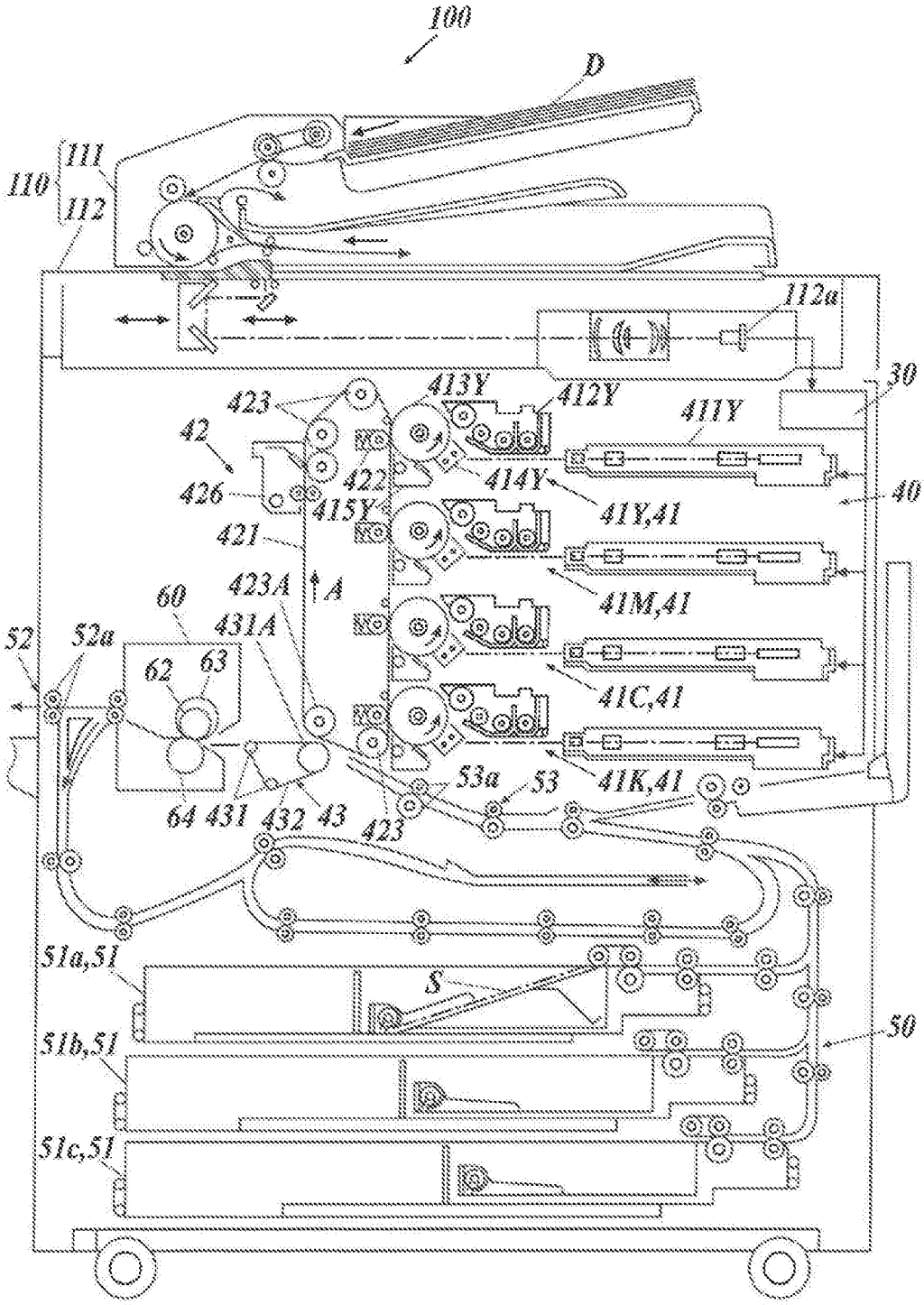
100
D
110
111
112
112a
30
423
413Y
412Y
411Y
42
422
414Y
426
415Y
41Y,41
40
421
423A
A
41M,41
60
431A
52
52a
62
63
41C,41
53a
53
41K,41
64
431
432
43
423
51a,51
S
50
51b,51
51c,51

ELECTROSTATIC LATENT IMAGE DEVELOPING TONER AND IMAGE FORMING METHOD

Japanese Patent Application No. 2018-040288, filed on Mar. 7, 2018 with Japan Patent Office, is incorporated herein by reference in its entirety.

TECHNICAL FIELD

The present invention relates to an electrostatic latent image developing toner and an image forming method. More specifically, the resent invention relates to an electrostatic latent image developing toner Which is less likely to cause a difference in image density and is excellent in cleaning performance of a photoreceptor when an electrophotographic image is formed by using the electrostatic latent image developing toner, and the present invention relates to an image forming method using this electrostatic latent image developing toner.

BACKGROUND

In an electrophotographic image forming apparatus, a lubricant may be necessary from the viewpoint of the cleaning property of the photoreceptor. Particularly when used in general offices, from the viewpoint of cost, a lubricant is often added to a toner instead of providing a lubricant coating mechanism as a process. At this time, since the lubricant is applied to the photoreceptor via the toner, it is difficult to uniformly apply the lubricant. Specifically, a lubricant such as an aliphatic acid metal salt particle has a larger particle diameter than other external additives, and is easily released from the toner. In addition, since the lubricant tends to have a positive chargeability, it is more likely to be applied to the non-image area for negatively chargeable toner.

Moreover, unless the lubricant is uniformly applied on the surface of the photoreceptor, there is a problem that a difference in image density occurs between the portion having a high concentration of the lubricant and the portion having a low concentration of the lubricant. In particular, in a charging method using a charging roller, since the lubricant on the surface of the photoconductor is generally liable to be decomposed, there is a problem that a difference in image density occurs remarkably.

Therefore, in the conventional toner, attempts have been made to control the application stare of the lubricant on the photoreceptor by combining a lubricant having a large particle size and a lubricant having a small particle size (see, for example, Patent Document 1: JP-A 2014-228763). However, it did not fully satisfy the demand from the market for reducing the image density difference.

SUMMARY

The present invention was done based on the above-described problems and situations. An object of the present invention is to provide an electrostatic latent image developing toner which is less likely to cause a difference in image density and is excellent in cleaning performance of a photoreceptor when an electrophotographic image is formed by using the electrostatic latent image developing toner, and also to provide an image forming method using this electrostatic latent image developing toner.

In order to solve the above-mentioned problem, the present inventors examined the cause of the above problem. And it was found the following. By incorporating inorganic particles having a number average particle diameter in the predetermined range and having Mohs hardness of the predetermined value or higher, and aliphatic acid metal salt particles having a number average particle diameter in the predetermined range in a toner as an external additive, it was found that, when an electrophotographic image is formed using the electrostatic latent image developing toner, it is difficult for a density difference to occur in the output image, and the cleaning performance of the photoreceptor is excellent. Thus the present invention has been achieved. Namely, the object of the present invention is solved by the following embodiments.

An electrostatic latent image developing toner reflecting an aspect of the present invention is a toner comprising toner mother particles having an external additive on a surface of the toner mother particles, wherein the external additive contains inorganic particles and aliphatic acid metal salt particles;

the inorganic particles have a number average particle diameter in the range of 10 to 50 nm, and have a Mohs hardness of 8 or more; and the aliphatic acid metal salt particles have a number average particle diameter in the range of 0.4 to 2.0 μm.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

FIGURE is a schematic diagram illustrating an example of an image forming apparatus.

DETAILED DESCRIPTION OF THE EMBODIMENTS

Hereinafter, one or more embodiments of the present invention will be described with reference to the drawings. However, the scope of the invention is not limited to the disclosed embodiments.

By the present invention, it is possible to provide an electrostatic latent image developing toner which is less likely to cause a difference in image density and is excellent in cleaning performance of a photoreceptor when an electrophotographic image is formed by using the electrostatic latent image developing toner, and it is also possible to provide an image forming method using this electrostatic latent image developing toner. A formation mechanism or an action mechanism of the effects of the present invention is supposed to be as follows.

In general, since aliphatic acid metal salt particles as a lubricant have a larger particle diameter than other external additive particles, they tend to be desorbed from the toner and tend to be applied to non-image areas on the surface of the photoreceptor. Thereby, a difference in coating amount occurs between the image area and non-image area. As a result, for example, when a halftone image is output, a density difference occurs in the output image due to the difference in the amount of lubricant applied on the surface of the photoreceptor.

An electrostatic latent image developing toner of the present invention (hereafter, it may be simply called as "a toner") includes an external additive containing inorganic particles and aliphatic acid metal salt particles, wherein the inorganic particles have a number average particle diameter in the range of 10 to 50 nm, and have a Mohs hardness of 8 or more; and the aliphatic acid metal salt particles have a number average particle diameter in the range of 0.4 to 2.0 μm. Although the reason is not certain, the aliphatic acid metal salt particles having a number average particle diameter in the range of 0.4 to 2.0 μm are easily pushed into the toner mother particles and become less likely to be separated from the toner mother particles. Therefore, it is presumed that the aliphatic acid metal salt particles are uniformly coated on the surface of the photoreceptor together with the toner mother particles, and accordingly, the image density difference may be reduced.

Also, since the inorganic particles having a high Mohs hardness are much harder than the toner mother particles, they are easily buried in the toner mother particles at the time of external addition. Further, when the aliphatic acid metal salt particles are present in the same toner mixture system, it is presumed that the effect of the inorganic particles efficiently embedding the aliphatic acid metal salt in the toner mother particles is exhibited. This makes it difficult for the aliphatic acid metal salt particles to be desorbed from the toner mother particles and to be uniformly coated on the surface of the photoreceptor together with the toner mother particles. As a result, it is presumed that image density difference may be reduced. In addition, small-diameter inorganic particles having a number average particle diameter of 50 nm or less have a number average particle diameter smaller than that of the aliphatic acid metal salt particles by 8 times or more. Therefore, one aliphatic acid metal salt particle is pressed with a plurality of inorganic particles, and it is presumed that the aliphatic acid metal salt particles could be pushed into the toner mother particles more efficiently. Further, by setting the number average particle diameter of the inorganic particles to 10 nm or more, it is presumed that the inorganic particles sufficiently obtained the action of pushing the aliphatic acid metal salt.

An electrostatic latent image developing toner of the present invention contains toner mother particles having an external additive on a surface of the toner mother particles, wherein the external additive contains inorganic particles and aliphatic acid metal salt particles; the inorganic particles have a number average particle diameter in the range of 10 to 50 nm, and have a Mohs hardness of 8 or more; and the aliphatic acid metal salt particles have a number average particle diameter in the range of 0.4 to 2.0 μm. This feature is a technical feature common or corresponding to the following embodiments.

As an embodiment of the present invention, from the viewpoint of more effectively obtaining the effect of the present invention, the inorganic particles are preferably alumina particles. The larger the difference in hardness between the toner mother particles and the inorganic particles, the more easily the inorganic particles are embedded in the toner mother particles, which is advantageous in that it is easy to immobilize them. Alumina particles are preferably used because the Mohs hardness is high and the hardness difference from the toner mother particles becomes large.

As an embodiment of the present invention, from the viewpoint of spreadability, the aliphatic acid metal salt particles are preferably at least one selected from the group consisting of zinc stearate particles, lithium stearate particles, and calcium stearate particles. The high spreadability makes it possible to apply the aliphatic acid metal particles more efficiently in the circumferential direction on the surface of the photoreceptor. Among them, zinc stearate particles are more preferable.

As an embodiment of the present invention, from the viewpoint of more effectively obtaining the effect of the present invention, it is preferable that the inorganic particles are surface-modified with a silane coupling agent, and the silane coupling agent has a structure represented by Formula (1), $X—Si(OR)_3$. From the viewpoint of the reactivity with the hydroxy group on the surface of the inorganic particle, it is preferable that the inorganic particle is surface-modified with a silane coupling agent. Here, in the silane coupling agent having the structure represented by Formula (1), X is preferably an alkyl group having 2 to 8 carbon atoms. When the number of carbon atoms is 8 or less, it becomes difficult for unreacted compound to be present and it is difficult to agglomerate the inorganic particles. Further, it is also possible to make it difficult for image defects to occur without excessively increasing the adhesion between the inorganic particles and the surface of the photoreceptor. By setting the number of carbon atoms to 2 or more, it is possible to increase the degree of hydrophobicity, prevent the inorganic particles from sticking to the photoreceptor, and make it difficult to cause image defects.

As an embodiment of the present invention, from the viewpoint of more effectively obtaining the effect of the present invention, it is preferable that the inorganic particles have a number average particle diameter in the range of 10 to 30 nm.

The electrostatic latent image developing toner of the present invention can also be suitably applied to a charging roller type image forming method in which the surface of a photoconductor is charged by a charging roller which is provided so as to contact the photoreceptor. In the image formation using the charging roller system, the lubricant on the surface of the photoreceptor is likely to be decomposed in general, and the difference in image density tends to be large. However, the image density difference may be suppressed by using the electrostatic latent image developing toner of the present invention.

The present invention and the constitution elements thereof, as well as configurations and embodiments, will be detailed in the following. In the present description, when two figures are used to indicate a range of value before and after "to", these figures are included in the range as a lowest limit value and an upper limit value.

[Electrostatic Latent Image Developing Toner (Toner)]

In the present invention, "toner" means an aggregate of "toner particles". In addition, the toner particles contain at least toner mother particles, and the toner particles are toner mother particles themselves or those obtained by adding at least an external additive to the toner mother particles.

<Toner Mother Particles>

The toner mother particles according to the present invention preferably contain other constituent components such as a colorant, a releasing agent (wax), and a charge controlling agent, as necessary, in the binder resin. An external additive is added to the surface of the toner mother particles according to the present invention. In addition, at least inorganic particles and aliphatic acid metal salt particles are used as the external additive.

(Particle Diameter of Toner Mother Particles)

The volume average particle diameter of the toner mother particles according to the present invention is preferably in the range of 4.0 to 8 μm. From the viewpoint of improving the image quality, it is preferable to have a smaller diameter, but when the particle size is small, the adhesion force of the toner mother particles is increased and the cleaning property is deteriorated. When the volume average particle diameter of the toner mother particles is within the above range, it is possible to satisfy both the image quality of the output image and the cleaning property, and also to compatibly balance functions such as charging, development, and transfer. The volume average particle diameter of the toner mother particles may be measured and calculated as a volume-based median diameter ($D_{50}$) as described above by using measuring equipment composed of "MULTISIZER 3" (Beckman Coulter Inc.) and a computer system installed with a data processing software "SOFTWARE V3.51".

Specific measuring processes are as follows. 0.02 g of the measuring sample (toner particles) is added to 20 mL of the surfactant solution and is allowed to be uniform, and then the solution is subjected to ultrasonic dispersion for one minute. As for the surfactant solution, it is prepared by diluting a neutral detergent containing a surfactant component with purified water by 10 times. This surfactant solution is appropriately used. The toner particle dispersion liquid thus prepared is dropwise added to "ISOTON II" (Beckman Coulter Inc.) in a beaker until the concentration to reach 5 to 10%. The measuring particle count of the measuring equipment is set to be 25,000. The aperture size of the measuring equipment is set to be 100 μm. The measuring range, which is from 2 to 60 μm, is divided into 256 sections to calculate the respective frequencies. The particle diameter where the accumulated volume counted from the largest size reaches 50% is determined as the volume-based median diameter ($D_{50}$) of the toner mother particles.

(Circularity of Toner Mother Particles)

The circularity of the toner mother particles used in the present invention is preferably such that the average circularity represented by the following numerical expression (1) is 0.920 to 1.000. When the degree of circularity of the toner mother particles is within the above range, the contact point between the toner particles becomes small, and sufficient transfer efficiency is obtained.

Average circularity of toner mother particles=(Perimeter of a circle having the same projected area as the particle image of the toner mother particles)/(Perimeter of the particle projected image of toner mother particle) Expression (1)

As a measurement example for determining the average circularity of the toner mother particles, measurement using an average circularity measuring apparatus "FPIA-2100" (manufactured by Sysmex Corp.) may be cited.

Specifically, a sample (toner mother particles) is mixed with an aqueous solution containing a surfactant, and it is further dispersed by ultrasonic treatment for 1 minute. Thereafter, measurement is performed by means of the "FPIA-2100" (Sysmex Corp.) in the conditions of the HPF (high power imaging) mode at an adequate concentration corresponding to an HPF detect number of 3000 to 10000.

(Core-Shell Structure)

It is preferable that the toner mother particles have a core-shell structure. The toner mother particles having a core-shell structure may be prepared as follows. First, binder resin particles for core material particles and colorant particles are aggregated and fused into core material particles. Then, binder resin particles for a shell layer are added to the dispersion liquid of core material particles, and the binder resin particles for a shell layer are aggregated and fused onto the surfaces of the core material particles to form a shell layer on the surfaces of the core material particles.

<Binder Resin>

The toner mother particles according to the present invention preferably contain an amorphous resin and a crystalline resin as a binder resin.

In the present invention, the crystalline resin indicates a resin having a distinct endothermic peak, rather than a stepwise endothermic change, in differential scanning calorimetry (DSC). The distinct endothermic peak indicates an endothermic peak having a half width within 15° C. or less at a heating rate of 10° C./min in the DSC.

On the other hand, the amorphous resin indicates a resin having a curve of a baseline indicating that the glass transition has occurred when performing the same differential scanning calorimetry as above, but the distinct endothermic peak as described above is not observed. The differential scanning calorimetry may be carried out using, for example, a DSC-7 differential scanning calorimeter (manufactured by PerkinElmer Inc.) and a TAC7/DX thermal analyzer controller (manufactured by PerkinElmer Inc.).

Specifically, 4.50 mg of sample is weighed, then sealed in an aluminum pan (KIT No. 0219-0041), and set in a sample holder of a differential scanning calorimeter "DSC-7". An empty aluminum pan is used as a reference. A temperature control of Heat-Cool-Heat is carried out at a measurement temperature of –0 to 200° C. a heating rate of 10° C./min, and a cooling rate of 10° C./min, and analysis is performed based on the data in the $2^{nd}$ Heat. The melting point is the temperature at the peak top of the endothermic peak.

(Amorphous Resin)

As the amorphous resin, it is preferable to use a vinyl resin formed using a vinyl monomer. Specifically, as the vinyl resin, it is preferable to use a styrene-acrylic resin, since charge control is easy. Here, the styrene-(meth)acrylic resin is a resin prepared through addition polymerization of at least a styrene monomer and a (meth)acrylate ester monomer. In this specification, the styrene monomer indicates styrene represented by the formula $CH_2{=}CH{-}C_6H_5$, and also includes monomers having a known side chain or functional group in a styrene structure. In this specification, the (meth)acrylate ester monomer indicates an acrylate or methacrylate ester compound represented by $CH_2{=}CHCOOR$ (where R is an alkyl group), and also includes ester compounds having a known side chain or functional group in the structure, such as acrylate ester derivatives and methacrylate ester derivatives.

Specific examples of styrene monomer and (meth) acrylic acid ester monomer capable of forming a styrene-acrylic resin are indicated below, but specific examples of the styrene-acrylic resin unit usable in the present invention are not limited to those indicated below. Specific examples of the styrene monomer include styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, and p-n-dodecylstyrene. These styrene monomers may be used alone or in combination of two or more.

Specific examples of the (meth)acrylate ester monomer include acrylate ester monomers, such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, and phenyl acrylate; and methacrylate ester monomers, such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, and dimethylaminoethyl methacrylate. The content of the styrene-acrylic resin is preferably 60 mass % or more with respect to the total amount of the binder resin.

<Crystalline Resin>

(Type of Crystalline Resin)

Examples of the crystalline resin include a crystalline polyester resin and a crystalline vinyl resin. Although not particularly limited, a crystalline polyester resin k preferable from the viewpoint of low-temperature fixability. As the crystalline polyester resin, a known polyester resin obtained by a polycondensation reaction of a divalent or higher valent carboxylic acid (polyvalent carboxylic acid) and a dihydric or higher alcohol (polyhydric alcohol) may be used.

(Hybrid Crystalline Polyester Resin)

It is more preferable that the crystalline polyester resin is a hybrid crystalline polyester resin containing an amorphous resin other than the crystalline polyester resin as a unit. It is preferable that the amorphous resin unit is composed of the same kind of resin as the amorphous resin contained in the binder resin, that is, the resin other than the hybrid resin. By hybridizing in such a form, the affinity between the crystalline polyester resin and the binder resin is enhanced, and the hybrid resin is easily taken in by the amorphous resin. As a result, since the crystalline polyester unit which is liable to adsorb moisture is present inside the toner mother body, it is possible to prevent adhesion between the toner particles from increasing due to moisture absorption, and the cleaning property is further improved. Here, "the same kind of resin" indicates the resin in which a characteristic chemical bond is commonly included in the repeating unit. The meaning of "the characteristic chemical bond" is determined by "polymer classification" indicated in a database provided by National Institute for Material Science (NIMS): (http://polymer.nims.go.jp/PoLyInfo/guide/jp/term_polymer.html). Namely, the chemical bonds which constitute the following 22 kinds of polymers are called as "the characteristic chemical bonds": polyacryls, polyamides, polyacid anhydrides, polycarbonates, polydienes, polyesters, poly-halo-olefins, polymides, polyimines, polyketones, polyolefins, polyethers, polyphenylenes, polyphosphazenes, polysiloxanes, polystyrenes, polysulfides, polysulfones, polyurethanes, polyureas, polyvinyls and other polymers.

(Content of Crystalline Resin)

The content of the crystalline resin contained in the toner mother particles according to the present invention is preferably in the range of 1 to 30 mass %. When the content of the crystalline resin in the toner mother particles is 1 mass % or more, the effect may be suitably exhibited. In addition, when the content of the crystalline resin in the toner mother particles is 30 mass % or less, occurrence of thermal aggregation (blocking) of the toner may be avoided.

<Colorant>

As the colorant contained in the toner mother particles of the present invention, known inorganic or organic colorants may be used. As the colorant, in addition to carbon black and magnetic powder, various organic and inorganic pigments and dyes may be used. The addition amount of the colorant is preferably in the range of 1 to 30 mass %, preferably 2 to 20 mass % with respect to the toner particles.

<Releasing Agent>

A releasing agent may be added to the toner mother particles according to the present invention. A wax is preferably used as the releasing agent. Examples of the wax include: hydrocarbon waxes such as low molecular weight polyethylene wax, low molecular weight polypropylene wax, Fischer-Tropsch wax, microcrystalline wax, and paraffin wax; and ester waxes such as carnauba wax, pentaerythritol behenate, behenyl behenate, and behenyl citrate. These may be used singly or in combination of two or more. The melting point of the wax is preferably 50 to 95° C. from the viewpoint of reliably obtaining low-temperature fixability and releasability of the toner. The content ratio of the wax is preferably in the range of 2 to 20 mass %, more preferably in the range of 3 to 18 mass %, still more preferably in the range of 4 to 15 mass % relative to the total amount of the binder resin.

<Charge Controlling Agent>

To the toner mother particles according to the present invention, a charge controlling agent may be added, when needed. A variety of known charge controlling may be used. As the charge controlling agent, known charge controlling agents that can be dispersed in an aqueous medium may be used. Specific examples thereof include: nigrosine dyes, metal salts of naphthenic acid or higher aliphatic acids, alkoxylated amines, quaternary ammonium salts, azo metal complexes, and salicylic acid metal salts or metal complexes thereof. The content ratio of the charge controlling agent is preferably in the range of 0.1 to 10 mass %, more preferably in the range of 0.5 to 5 mass %, based on the total amount of the binder resin.

<External Additive>

On the surface of the toner mother particles according to the present invention, inorganic particles and aliphatic acid metal salt particles are contained as external additives. The aliphatic acid metal salt particles have a function as a lubricant for further improving the cleaning property and transferability.

<Inorganic Particles>

The toner particle according to the present invention contains, as an external additive, inorganic particles having a number average particle diameter in the range of 10 to 50 nm and a Mohs hardness of the inorganic particles of 8 or more.

The toner of the present invention contains hard inorganic particles having a Mohs hardness of 8 or more. Since the inorganic particles are much harder than the toner mother particles, they tend to be buried in the toner mother particles when externally added. Further, when the aliphatic acid metal salt particles are present in the same toner mixing system, it is presumed that the effect of the inorganic particles efficiently embedding the aliphatic acid metal salt in the toner mother particles is exhibited. This makes it difficult for the aliphatic acid metal salt particles to be desorbed from the toner mother particles and to be uniformly coated on the surface of the photoreceptor together with the toner mother particles. Therefore, it is assumed that image density difference may be reduced.

(Particle Diameter of Inorganic Particles)

The number average particle diameter of the inorganic particles is in the range of 10 to 50 nm, more preferably in the range of 10 to 30 nm, from the viewpoint that it can be fixed to the toner mother particles with high adhesion. Small diameter inorganic particles having a number average particle diameter of 50 nm or less are much smaller than aliphatic acid metal salt particles, so that one aliphatic acid metal salt particle is pressed with a plurality of inorganic particles. Therefore, it is presumed that the aliphatic acid metal salt particles could be pushed into the toner mother particles more efficiently. Further, by setting the number average particle diameter of the inorganic particles to 10 nm or more, it is presumed that the inorganic particles sufficiently obtained the action of pushing the aliphatic acid metal salt.

(Measuring Method of Number Average Particle Diameter)

The number average particle diameter of the inorganic particles according to the present invention may be measured by the following method. An SEM image magnified 50,000 times is captured with a scanning electron microscope (SEM) "JSM-7401F" (manufactured by JEOL Ltd.), and the inorganic particles in the SEM image are binarized with an image analyzer LUZEX AP (manufactured by NIRECO CORPORATION). The horizontal Feret diameters of 100 inorganic particles are calculated, and the average is defined as the number average particle diameter.

(Mohs Hardness and Type of Inorganic Particles)

Mohs hardness is devised by F. Mohs. The following ten kinds of minerals are selected, and the target is successively scratched with these materials. It is assumed that the hardness of the target is lower than that mineral, when the target is scratched. The minerals are in ascending order of hardness, 1: talc, 2: gypsum, 3: calcite, 4: fluorite, 5: apatite, 6: orthoclase, 7: quartz, 8: topaz, 9: corundum, 10: diamond.

Examples of the inorganic particles according to the present invention include alumina (Mohs hardness: 8 to 9), silicon carbide (Mohs hardness: 9) and surface modification products thereof. Of these, alumina is preferable from the viewpoint of cost. In addition, if the Mohs hardness is 8 or more, there is not much difference in its effect.

(Hydrophobic Treatment)

The surface of the inorganic particles is preferably subjected to hydrophobic treatment, and the degree of hydrophobicity is preferably 40 or more. Further, it is preferable that the release rate of the surface modifying agent when subjected to the hydrophobic treatment is 0. This is because if a free surface modifier is present, it migrates to the carrier and the charge amount fluctuation increases. For the surface modification, a known surface modification method may be used, for example, a dry method or a wet method may be used. As the surface modifying agent, a known silane coupling agent described later may be used.

In the thy method, it is preferable to stir or mix the particles serving as a raw material and the hydrophobic agent in the fluidized bed reactor. In the wet method, it is preferable to perform the following procedure. That is, particles as a raw material are dispersed in a solvent to form a slurry of particles serving as a raw material. Subsequently, a hydrophobic agent is added to this slurry to modify (to make hydrophobic state) the surface of the particles as a raw material. At this time, it is preferable to heat the particles as the raw material and the hydrophobic agent in the range of 100 to 200° C. for 0.5 to 5 hours. By such heat treatment, it is possible to effectively modify the silanol groups on the surface of the particles as raw materials. The amount of the treating agent (surface modifying agent) is not particularly limited, but it is preferably from 5 to 30 mass parts, more preferably from 8 to 20 mass parts, per 100 mass parts of the raw material particles.

The hydrophobic agent may be one kind or more. Known compounds such as silane coupling agent, silicone oil, titanate coupling agent, aluminate coupling agent, aliphatic acid, aliphatic acid metal salt, esterified product thereof and rosin acid may be used. However, a silane coupling agent is preferred from the viewpoint of reactivity with the hydroxy group on the surface of the inorganic particle. Examples of the silane coupling agent are: dimethyldimethoxysilane, hexamethyldisilazane (HMDS), methyltrimethoxysilane, isobutyltrimethoxysilane and decyltrimethoxysilane.

In particular, the silane coupling agent preferably has a structure represented by the following Formula (1).

$$X—Si(OR)_3 \qquad \text{Formula (1)}$$

In Formula (1), X represents an alkyl group having 2 to 8 carbon atoms, and R represents a methyl group or an ethyl group. By making X to be an alkyl group having carbon atoms of 8 or less, it becomes difficult for unreacted compound to be present and it is difficult to agglomerate the inorganic particles. Further, it is also possible to make it difficult for image defects to occur without excessively increasing the adhesion between the inorganic particles and the surface of the photoreceptor. By making X to be an alkyl group having carbon atoms of 2 or more, it is possible to increase the degree of hydrophobicity, prevent the inorganic particles from sticking to the photoreceptor, and make it difficult to cause image defects.

(Measuring Method of Hydrophobicity)

The degree of hydrophobicity may be determined by conducting measurement as follows using a powder wettability tester (WET-101P; manufactured by RHESCA Co. Ltd.). Hereinafter, an example in which the degree of hydrophobicity of alumina particles is measured will be described.

In a laboratory environment, a stirrer chip of 20 mm in length and 60 mL of ion-exchanged water at 25° C. are placed in a 200 mL tall beaker and set in a powder wettability tester (WET-101P; manufactured by RHESCA Co. Ltd.). 50 mg of alumina particles is floated on ion-exchanged water, the lid and the methanol supply nozzle are immediately set, and the measurement is started simultaneously with the start of agitation with stirrer. Supply rate of methanol (special grade methanol, manufactured by Kanto Kagaku Co., Ltd.) is set to 2.0 mL/min, and measurement time is set to 70 minutes. The agitator speed of the stirrer is set to 380 to 420 rpm. The alumina particles initially float at the interface of the ion-exchanged water, but as the methanol concentration rises, the alumina particles are gradually wetted by the mixed solution of ion-exchanged water and methanol and dispersed in the liquid. As a result, the light transmittance of the liquid gradually decreases. From the obtained data, the methanol concentration (vol %) calculated from the methanol supply amount (mL) on the horizontal axis and the light transmittance (voltage ratio) (%) on the vertical axis are plotted. The methanol concentration when the light transmittance is halfway between the maximum value and the minimum value is defined as "degree of hydrophobicity".

(Producing Method of Alumina Particles)

The alumina particle according to the present invention refers to aluminum oxide represented by $Al_2O_3$, and forms of α type, γ type, σ type, and a mixture thereof are known. Regarding to the shape of the particles, it is known that cubic shape to spherical shape that are produced by the control of the crystalline type. The alumina particles according to the present invention may be prepared by a known method. As a method for preparing the alumina particles, the Bayer method is common. In order to obtain highly pure and nano-sized alumina, there are cited a hydrolysis method (manufactured by Sumitomo Chemical Co. Ltd.), a gas phase synthesis method (manufactured by CI Kasei Co. Ltd.), a flame hydrolysis method (manufactured by Nippon Aerosil Co. Ltd.), and an underwater spark discharge method (manufactured by Iwatani Chemical Industry Co. Ltd.).

The shape of the alumina particles may be controlled as follows. Based on the existing thermal spraying technique, the raw material powder is charged into a high-temperature flame formed with a fuel gas such as hydrogen, natural gas, acetylene gas, propane gas, and butane, and the raw material powder is melted to spheroidize. In addition, as the supply method when the alumina raw material powder is charged into the flame, a dry method using oxygen, air, nitrogen, or argon as a carrier gas may be used, and a wet method using a slurry using water, methanol, or ethanol as a dispersion medium may also be used.

An example of the manufacturing apparatus has a spheroidizing furnace and a collecting device connected to the furnace as a basic configuration. The spherical alumina powder produced in the spheroidizing furnace is pneumatically transported by a blower and recovered by a collecting device. It is preferable that the spheroidizing furnace main body and the transportation pipe are water cooled by a water cooling jacket system. As the collecting device, cyclone, gravity settling, louver, or bag filter are used. The collection temperature is determined by the amount of heat generated by the amount of combustible gas and the amount of suction by the blower, and adjustment is made by the amount of cooling water and the amount of outside air taken in the line.

The shape and particle size of the alumina particles can be varied by reaction conditions, such as flame temperature, hydrogen or oxygen content, quality of the alumina raw material powder, residence time in the flame, or the length of the coalescing zone.

<Aliphatic Acid Metal Salt Particles>

The surface of the toner mother particles according to the present invention contains aliphatic acid metal salt particles as an external additive. The number average particle diameter of the aliphatic acid metal salt particles is in the range of 0.4 to 2.0 μm. The aliphatic acid metal salt particles having a number average particle diameter in the range of 0.4 to 2.0 μm are easily pushed into the toner mother particles and are hardly detached from the toner mother particles. Therefore, it is presumed that the effect of the present invention was effectively obtained. The number average particle diameter of the aliphatic acid metal salt particles may be measured by the same method as the method for measuring the number average particle diameter of the inorganic particles as described above.

As the aliphatic acid metal salt particles, known aliphatic acid metal salt particles may be used, but from the viewpoint of spreadability, it is preferable to use aliphatic acid metal salt particles having Mohs hardness of 2 or less. The metal of the aliphatic acid metal salt particle is preferably one selected from the group consisting of zinc, calcium, magnesium, aluminum and lithium.

As the aliphatic acid metal salt particles according to the present invention, it is preferable to use at least one selected from the group consisting of zinc stearate particles, lithium stearate particles and calcium stearate particles. Among them, zinc stearate particles are more preferable.

The aliphatic acid of the aliphatic acid metal salt particles is preferably a higher aliphatic acid having 12 to 22 carbon atoms. When an aliphatic acid having 12 or more carbon atoms is used, generation of free aliphatic acid may be suppressed, and when the carbon number of the aliphatic acid is 22 or less, the melting point of the aliphatic acid metal salt particle does not become too high and good fixability is obtained. As the aliphatic acid, stearic acid is particularly preferable. As the aliphatic acid metal salt particles used in the present invention, zinc stearate particles, calcium stearate particles, lithium stearate particles and magnesium stearate particles are preferable. Among these, zinc stearate particles are more preferable. Two or more of these aliphatic acid metal salt particles may be used in combination.

<Other External Additives>

In addition to the above-mentioned inorganic particles and aliphatic acid metal salt particles, known organic particles and inorganic particles may be used as the external additives of the toner according to the present invention. One or more external additives may be used, and it is particularly preferable to use two or more external additives having different particle diameters. Different particle sizes have different roles as external additives. In general, the larger the diameter, the more the spacer effect is exerted and the adhesion force between the toner particles is lowered. As the diameter is smaller, the surface of the toner mother particles may be more easily covered, so that the fluidity may be raised. Regarding the shape, not only spherical external additives but also needle-like ones typified by rutile type titanium oxide, as well as irregular shapes, spindle shapes, and spinous shapes may be used without limitation.

Examples of the inorganic particles used for other external additives include: silica particles, titanium oxide particles, alumina particles, zirconia particles, zinc oxide particles, chromium oxide particles, cerium oxide particles, antimony oxide particles, tungsten oxide particles, tin oxide particles, tellurium oxide particles, manganese oxide particles and boron oxide particles. Among them, particles of silica, titanium oxide, alumina, and strontium titanate are preferable. It is preferable that the surface of the inorganic particle is subjected to a hydrophobic treatment, and a known surface modifier is used for the hydrophobic treatment. The surface modifying agent may be one kind or more. Examples of the surface modifier include silane coupling agents, silicone oils, titanate coupling agents, aluminate coupling agents, aliphatic acids, metal salts of aliphatic acids, esterified compounds thereof, and rosin acids. Examples of the silane coupling agent include dimethyldimethoxysilane, hexamethyldisilazane (HMDS), methyltrimethoxysilane, isobutyltrimethoxysilane and decyltrimethoxysilane. Examples of the silicone oil include a cyclic, linear or branched organosiloxane. Specific examples of the silicone oil include organosiloxane oligomers, octamethylcyclotetrasiloxane, decamethylcyclopentasiloxane, tetramethylcyclotetrasiloxane, and tetravinyltetramethylcyclotetrasiloxane.

As the organic particles used for other external additives, spherical organic particles having a number average primary particle diameter of about 10 to 2000 nm may be mentioned. Specifically, organic particles composed of a homopolymer of styrene or methyl methacrylate or a copolymer thereof may be used.

(Titanium Oxide Particles)

It is preferable that the toner according to the present invention contains, as an external additive, 0.10 to 0.80 mass % of titanium oxide particles having an average aspect ratio of 2 to 15, more preferably 5 to 13, as determined from the number average particle diameter. By using titanium oxide particles having a high aspect ratio as described above as an external additive, toner coverage may be increased. Further, since the contact area with the toner mother particle is large, it is difficult to detach from the toner, and the surface state of the toner may be kept satisfactory irrespective of printing conditions. Further, the average aspect ratio of the titanium oxide particles may be obtained (long diameter/short diameter) using the number average long diameter and the short diameter. The number average long diameter and the short diameter may be determined, for example, by measuring the particle size of titanium oxide particles in an electron micrograph obtained using a scanning electron microscope (SEM) "JSM-7401F" (manufactured by JEOL Ltd.). It may be obtained as an average value of n=20. The crystal structure of titanium oxide is preferably rutile type. Compared to the anatase type, the rutile type titanium oxide has a higher calcination temperature and less surface hydroxyl groups. From this fact, it is possible to prevent an increase in adhesion between toner particles due to moisture adsorption.

(Silica Particles)

The toner according to the present invention preferably contains silica particles as an external additive. As a method for producing the silica particles, a known production method, that by a dry method such as a combustion method, an arc method, and a melting method; and that by a wet method such as a precipitation method, a gel method, and a sol-gel method may be mentioned. When a silica compound is used, there is no particular limitation, but it is preferable to mix and use about 3 to 4 types of silica compounds having different average particle sizes. This is because the silica compound having a smaller particle diameter contributes to the fluidity of the toner, and the silica compound having a larger particle size plays a role of protecting the silica compound having a smaller particle diameter from external force. For example, silica compounds each having a particle diameter of 5 to 18 nm, 20 to 40 nm, 70 to 90 nm, and 100 to 140 nm may be mixed for use. The mixing ratio is not particularly limited and may be suitably adjusted. For example, silica compounds having different particle diameters may be used in an amount of 0.05 to 1.0 mass % with respect to the toner mother particles, respectively.

<Two-Component Developer>

The two-component developer may be obtained by appropriately mixing toner particles and carrier particles so that the toner particle content (toner concentration) is 4.0 to 8.0 mass %. Examples of the mixing device used for the mixing include NAUTA MIXER, a Double cone mixer, and a V mixer.

<Carrier Particles>

The carrier particles according to the present invention are made of a magnetic substance. Examples of the carrier particles include: coated carrier particles having a carrier core (a core material particle) made of a magnetic substance and a layer of a carrier coat resin (coating material) covering the surface of the carrier core; and resin-dispersed carrier particles in which fine powder of a magnetic substance is dispersed in a resin. Preferred carrier particles are coated carrier particles to reduce the adhesion of the carrier particles onto a photoreceptor.

<Carrier Core (Core Material Particle)>

The core material particle is constituted by a magnetic material, for example, a substance strongly magnetized in the direction of a magnetic field. The magnetic material may be of one kind or more. Examples of such a magnetic substance include ferromagnetic metals, such as iron, nickel, and cobalt; alloys and compounds containing these metals; and alloys demonstrating ferromagnetism after subjected to a heat treatment.

Examples of the ferromagnetic metals and the alloys and compounds containing these metals include iron, ferrites represented by Formula (a), and magnetite represented by Formula (b). In Formulas (a) and (b), M represents one or more mono or divalent metals selected from the group consisting of Mn, Fe, Ni, Co, Cu, Mg, Zn, Cd, and Li.

$$MO \cdot Fe_2O_3 \qquad \text{Formula (a)}$$

$$MFe_2O_4 \qquad \text{Formula (b)}$$

Examples of the alloys demonstrating ferromagnetism after subjected to a heat treatment include Heusler alloys, such as manganese-copper-aluminum and manganese-copper-tin; and chromium dioxide. Among these core material particles, preferred are a variety of ferrites. This is because the specific gravity of the coated carrier particles is smaller than the specific gravity of the metal constituting the core material particles, the impact force of stirring in the developing device may be further reduced.

<Carrier Coat Resin (Coating Material)>

As the coating material, a known resin used for coating the core material particles of the carrier particles may be used. The preferred coating material is a resin having a cycloalkyl group to reduce the moisture adsorption of the carrier particles and enhance the adhesion between the coating material and the core particles. Examples of the cycloalkyl group include cyclopropyl, cyclobutyl, cyclopentyl, cyclohexyl, cycloheptyl, cyclooctyl, cyclononyl, and cyclodecyl groups. Among these cycloalkyl groups, preferred is a cyclohexyl group in view of the close adhesion between the coating material and the ferrite particle. The weight average molecular weight of the resin is in the range of 10,000 to 800,000, more preferably 100,000 to 750,000. The content of the structural unit having the cycloalkyl group in the resin is 10 to 90 mass %, for example. The content of the structural unit having the cycloalkyl group in the resin may be determined by pyrolysis-gas chromatography/mass spectrometry (Py-GC/MS) or $^1$H-NMR, for example.

[Production Method of Electrostatic Latent Image Developing Toner]

The production method of the toner according to the present invention is not particularly limited. Any known methods may be used. Examples of the method include: a kneading pulverization method, a suspension polymerization, an emulsion aggregation method, a dissolution suspension method, a polyester extension method, and a dispersion polymerization method. Among these processes, preferred is an emulsion aggregation method in view of the uniformity of the particle size and control of the shape of the toner.

<Emulsion Aggregation Method>

In the emulsion aggregation method, toner particles are prepared as follows. A resin particle dispersion liquid is obtained by dropping a poor solvent into a binder resin solution dissolved in a solvent to make phase inversion emulsification, followed by desolvation. This resin particle dispersion liquid, a colorant dispersion liquid, and a releasing agent dispersion liquid such as wax are mixed, the mixture is aggregated until the diameter of the desired toner particles is reached, and fusion of the binder resin particles is further performed. Thereby, toner particles are obtained. An example of a method for producing toner particles by the emulsion aggregation method will be described below. Toner particles are produced by carrying out the following steps (1) to (6).

(1) a step of preparing a dispersion liquid of colorant particles dispersed in an aqueous medium, (2) a step of preparing a dispersion liquid of binder resin particles containing internal additives when necessary in aqueous media, (3) a step of forming toner mother particles by mixing the dispersion liquid of colorant particles with the dispersion liquid of binder resin particles for achieving aggregation, association, and fusion, (4) a step of removing the surfactant by filtering the toner mother particles from the dispersion system (aqueous medium) of the toner mother particles, (5) a step of drying the toner mother particles, and (6) a step of adding an external additive to the toner mother particles.

(Coagulant)

The coagulant used in the above-described step (3) is not limited in particular, but it is preferably selected from metal salts. Examples of the metal salts include: monovalent metals salts of alkali metals such salts of sodium, potassium and lithium; divalent metal salts of alkali earth metal salts such as salts of calcium, magnesium, manganese and copper; and trivalent metal salts of iron and aluminum. Specific examples of such metal salts include sodium chloride, potassium chloride, lithium chloride, calcium chloride, magnesium chloride, zinc chloride, copper sulfate, magnesium sulfate, and manganese sulfate. Among them, divalent metal salts are particularly preferred since the aggregation is caused by a smaller amount. These coagulants may be used alone or in combination of two or more kinds.

The binder resin particles containing an internal additive when necessary in the above-described step (2) may be produced so as to have a multilayer structure of two or more layers. For example, when producing binder resin particles having a three-layer structure, they may be produced by carrying out a polymerization reaction for synthesizing binder resin particles in three stages: a first stage polymerization (formation of inner layer), a second stage polymerization (formation of intermediate layer), and a third stage polymerization (formation of outer layer). Here, in the respective polymerization reactions of the first stage polymerization to the third stage polymerization, binder resin particles having a three-layer constitution different in composition may be produced by changing the composition of the polymerizable monomer. Further, for example, in any one of the first stage polymerization to the third stage polymerization, it is possible to form binder resin particles having a three-layer constitution by conducting the synthesis reaction of the binder resin in a state of containing an appropriate internal additive such as a releasing agent.

<External Additive Treatment>

A mechanical mixing apparatus may be used as the external additive mixing treatment on the toner mother particles. The mechanical mixer used may be a HENSCHEL MIXER, a NAUTA MIXER, or a TURBULAR MIXER. Among these mixers, a HENSCHEL MIXER, which can impart shear force to the particles, may be used to mix the materials for a longer time or with a stirring blade at a higher circumferential speed of rotation. When several kinds of external additives are used, all of the external additives may be mixed with the toner particles in one batch, or several aliquots of the external additives may be mixed with the toner particles.

In the mixing of the external additive, the degree of crush or adhesive strength of the external additive may be controlled with the mechanical mixer through control of the mixing strength or circumferential speed of the stirring blade, the mixing time, or the mixing temperature.

[Image Forming Method]

The electrostatic latent image developing toner of the present invention may be suitably applied to an image forming method having a step of charging the surface of the photoreceptor with a charging roller which is provided so as to contact the photoreceptor. In the image forming method having the step of charging the surface of the photoreceptor with the charging roller, the lubricant on the surface of the photoreceptor is likely to be decomposed and the image density difference tends to be large. However, it is possible to reduce the image density difference by using the electrostatic latent image developing toner of the present invention.

An example of a preferable image forming method using the electrostatic latent image developing toner of the present invention will be described with reference to the image forming apparatus illustrated in FIGURE. The image forming method of the present invention is characterized in that an image is formed on a substrate using a toner for developing an electrostatic latent image of the present invention. Specifically, a preferable electrophotographic image forming method contains a charging step, an exposing step, a developing step and a transferring step. In the transfer step, it is preferable that this step has a primary transfer step of transferring the toner image from the electrostatic latent image carrier (photoreceptor drum 413) onto the intermediate transfer body (intermediate transfer belt 421), and a secondary transfer step of transferring the toner image onto a transfer material (paper S).

An image forming apparatus 100 illustrated in FIGURE ncludes an image reading section 110, an image processing section 30, an image forming section 40, a sheet conveyance section 50, and a fixing device 60.

The image forming section 40 contains image forming units 41Y, 41M, 41C, and 41K each forming an image of each color of Y(yellow), M(magenta), C(cyan), and K(black). Since these units each have the same composition except the incorporated toner, the symbol designating the color may be omitted hereafter. The image forming section 40 further contains an intermediate transfer unit 42 and a secondary transfer unit 43. These correspond to a transfer device.

The image forming units 41 includes an exposure device 411, a developing device 412, a photoreceptor drum 413, a charging device 414, and a drum cleaner 415. The photoreceptor drum 413 is a negatively-charged organic photoreceptor, for example. The surface of the photoreceptor drum 413 has a photoconductive property. The photoreceptor drum 413 corresponds to a photoreceptor.

It is preferable that the charging device 414 is of a charging roller type in which the surface of the photoreceptor drum 413 is charged by a charging roller provided so as to contact the photoreceptor drum 413. In the image formation using the charging roller system, the lubricant on the surface of the photoreceptor is generally liable to be decomposed and the image density difference tends to be large, but when the toner for developing an electrostatic latent image of the present invention is used, it is possible to suppress the difference in image density. The charging device 414 may be a contact charging device which contacts with the photoreceptor drum 413 through a contact charging member such as a charging roller, a charging brush, or a charging blade to result in charging. The exposure device 411 includes a semi-conductor laser as a lighting source, and a light polarization device (polygon motor) that irradiates laser light to the photoreceptor drum 413 in accordance with the image to be formed.

The developing device 412 is a device using a two-component developing method. The developing device 412 contains a developing container that contains a two-component developer, a developing roller (a magnetic roller) rotatably placed at the opening portion of the developing container, a partition that divides the inside of the developing container in a way that the two-component developer may communicate, a transport roller for transporting the two-component developer at the opening side of the developing container toward the developing roller, and a mixing roller that mixes the two-component developer in the developing container. The developing container contains the above-described toner as a two-component developer.

The intermediate transfer unit 42 includes an intermediate transfer belt 421, a primary transfer roller 422 that presses the intermediate transfer belt 421 to the photoreceptor drum 413, a plurality of support rollers 423 including a backup roller 423A, and a belt cleaner 426. The intermediate transfer belt 421 is stretched in a loop state over a plurality of support rollers 423. Rotation of at least one driving roller among the plurality of support rollers 423 causes the intermediate transfer belt 421 to run in the direction indicated by an arrow A at a constant speed.

The secondary transfer unit 43 contains a secondary transfer belt 432 having an endless shape, and a plurality of support rollers 431 including a secondary transfer roller 431A. The secondary transfer belt 432 is stretched in a loop state by the secondary transfer roller 431A and the support rollers 431.

The fixing device 60 includes: a fixing roller 62, a heating belt 63 of an endless belt that covers the outer peripheral surface of the fixing roller 62 so as to heat and melt the toner constituting the toner image on a sheet S, and a pressure roller 64 that presses the sheet S to the fixing roller 62 and the heating belt 63.

The image forming apparatus 100 further includes the image reading section 110, the image processing section 30, and the sheet conveyance section 50. The image reading section 110 includes a sheet feeding device 111 and a scanner 112. The sheet conveyance unit 50 includes a sheet feeding section 51, a sheet output section 52, and a sheet pathway section 53. Three tray units 51*a* to 51*c* that constitute the sheet feeding section 51 each respectively contain the predetermined sheets S (a standard sheet and a special sheet) identified based on the weight and the size. The sheet pathway section 53 contains a plurality of transport roller pairs such as a pair of register rollers 53*a*.

An example of an image forming process with the image forming apparatus 100 will be described. The scanner 112 reads a draft D on a contact glass through optical scanning. The reflective light from the draft D is read by a CCD sensor 112*a*. This reflective light becomes an input image data. The input image data is subjected to a predetermined image processing in the image processing section 30, and it is sent to the exposure device 411.

The photoreceptor drum 413 rotates with a predetermined peripheral speed. The charging device 414 uniformly charges the surface of the photoreceptor drum 413 with a negative polarity. In the exposure device 411, a polygon mirror of the polygon motor rotates with a high speed. The laser light corresponding to the input image data of each color component is moved along with the axis direction of the photoreceptor drum 413. The laser light is irradiated in the axis direction of the outer peripheral surface of the photoreceptor drum 413. Thus, an electrostatic latent image is formed on the surface of the photoreceptor drum 413.

In the developing device 412, the toner particles are charged by mixing and transporting of the two-component developer in the developer container. The two-component developer is transported to the developing roller, and it forms a magnetic brush on the developing roller. The charged toner particles electrostatically adhere to the electrostatic latent image portion on the surface of the photoreceptor drum 413. In this way, the electrostatic latent image on the surface of the photoreceptor drum 413 is visualized. A toner image corresponding to the electrostatic latent image is formed on the photoreceptor drum 413.

The toner image on the surface of the photoreceptor drum 413 is transferred to the intermediated transfer belt 421 in the intermediate transfer unit 42. After transfer of the toner, the remaining toner on the surface of the photoreceptor drum 413 is removed by the drum cleaner 415 having a drum cleaning blade which slidably contacts with the surface of the photoreceptor drum 413.

The intermediate transfer belt 421 is pressed against the respective photoreceptor drums 413 through the primary transfer rollers 422. As a result, there are formed primary transfer nip parts for each photoreceptor drum by the photoreceptor drums 413 and the intermediate transfer belt 421. In the primary transfer nip part, each toner image is sequentially transferred to the intermediate transfer belt 421.

On the other hand, the secondary transfer roller 431A is pressed against the backup roller 423A through the intermediate transfer belt 421 and the secondary transfer belt 432. There is formed a secondary transfer nip part by the intermediate transfer belt 421 and the secondary transfer belt 432. The sheet S passes through the secondary transfer nip part. The sheet S is transported to the secondary transfer nip part by the sheet conveyance section 50. The correction of an inclination of the sheet S and adjustment of the timing of the transport are done in the register roller section located with a pair of register rollers 53*a*.

When the sheet S is conveyed to the secondary transfer nip part, a bias voltage for transfer is applied to the secondary transfer roller 431A. By application of the bias voltage for transfer, the toner images held on the intermediate transfer belt 421 are transferred onto the sheet S. The sheet S on which the toner images have been transferred is conveyed to the fixing unit 60 by the secondary transfer belt 432.

The fixing device 60 forms a fixing nip part by the heating belt 63 and the pressure roller 64. The conveyed sheet S is heated and pressed in the fixing nip part. The toner particles constituting the toner image of the sheet S are heated. The crystalline resin promptly melts in the toner particles. As a result, the whole toner particles melt with a relatively small amount of heat, and the toner component adheres to the sheet S. In this manner, the toner image is rapidly fixed on the sheet S with a relatively small amount of heat. The sheet S having a fixed image is ejected outside the apparatus through the sheet output section 52 equipped with a sheet output roller 52*a*. Thus, a high quality image is formed.

The transfer-remaining toner remained on the surface of the intermediate transfer belt 421 after the secondary transfer is removed by the belt cleaner 426 having a belt cleaning blade that slidably contacts with the surface of the intermediate transfer belt 421.

Although the embodiments of the present invention have been described and illustrated in detail, the disclosed embodiments are made for purpose of illustration and example only and not limitation. The scope of the present invention should be interpreted by terms of the appended claims.

EXAMPLES

Hereinafter, specific examples of the present invention will be described, but the present invention is not limited thereto.

[Preparation of Inorganic Particles]

As the alumina particles which are the inorganic particles according to the present invention, those produced by a known method may be used. Hereinafter, the present invention will be specifically described with reference to examples, but the method for producing alumina particles of the present invention is not limited thereto. Production of alumina particles according to the present invention was made by adapting to the known burner device described in Example 1 of European Patent No. 0585544 with reference to the contents of Japanese Patent Application Publication No. 2012-224542.

<Preparation of Inorganic Particles 1>

320 kg/h of aluminum trichloride ($AlCl_3$) was evaporated in an evaporator at about 200° C., and the chloride vapor was passed by nitrogen into the mixing chamber of the burner. Here, the gas stream was mixed with 100 $Nm^3$/h of hydrogen and 450 $Nm^3$/h of air and fed to the flame via a central tube (7 mm diameter). As a result, the burner temperature was 230° C. and the discharge speed of the tube was about 35.8 m/s. 0.05 $Nm^3$/h of hydrogen was supplied as a jacket type gas via the outer tube. The gas burned in the reaction chamber and cooled to about 110° C. in the downstream coalescence zone. In that place, aggregation of primary particles of alumina particles was performed. Here, from the simultaneously generated hydrochloric acid-containing gas, the obtained alumina particles were separated with a filter or in a cyclone, and the powder having moist air was treated at about 500 to 700° C., thereby the adherent chloride was removed. In this way, inorganic particles 1 having a number average particle diameter of 15 nm were obtained. In addition, the Mohs hardness of the inorganic particles 1 was 8. The particle size of the alumina particles may be varied by reaction conditions such as flame temperature, hydrogen or oxygen content, quality of aluminum trichloride, residence time in the flame or length of the coalescing zone.

(Surface Modification)

The inorganic particles 1 obtained above were placed in a reaction vessel. While stirring the powder with a rotary blade in a nitrogen atmosphere, one obtained by diluting 20 g of isobutyltrimethoxysilane, which is a surface modifier (hydrophobic agent), with 60 g of hexane was added to 100 g of alumina powder. After stirring at 200° C. for 120 minutes and cooling with cooling water, surface-modified inorganic particles 1 were obtained.

<Preparation of Inorganic Particles 2 to 4, 11 and 12>

Inorganic particles 2 to 4, 11 and 12 were prepared in the same manner as in the above method of preparing the inorganic particles 1 except that the flame temperature was changed so that the number average particle diameter as described in Table I was obtained.

<Preparation of Inorganic Particles 5>

Inorganic particles 5 were prepared in the same manner as in the method of preparing the inorganic particles 1 except that isobutyltrimethoxysilane was changed to n-octyltrimethoxysilane.

<Preparation of Inorganic Particles 6>

Inorganic particles 6 were prepared in the same manner as in the method of preparing the inorganic particles 1 except that isobutyltrimethoxysilane was changed to decyltrimethoxysilane.

<Preparation of Inorganic Particles 7>

Inorganic particles 7 were prepared in the same manner as in the method of preparing the inorganic particles 1 except that isobutyltrimethoxysilane was changed to ethyltrimethoxysilane.

<Preparation of Inorganic Particles 8>

Inorganic particles 8 were prepared in the same manner as in the method of preparing the inorganic particles 1 except that isobutyltrimethoxysilane was changed to trimethoxy (methyl)silane.

<Inorganic Particles 9>

As the inorganic particles 9, silicon carbide particles having a number average particle diameter of 15 nm (product name: NM SiC 99, manufactured by Nanomakers Co. Ltd.) were used.

<Preparation of Inorganic Particles 10>

Inorganic particles 10 were prepared in the same manner as in the method of preparing the inorganic particles 1 except that the firing temperature conditions were changed so that the Mohs hardness became 9.

<Inorganic Particles 13>

As inorganic particles 13, hydrophobic silica particles having a number average particle diameter of 15 nm (product name: R805, manufactured by Nippon Aerosil Co. Ltd.) were used.

<Preparation of Inorganic Particles 14>

Inorganic particles 14 were prepared in the same manner as in the method of preparing the inorganic particles 1 except that isobutyltrimethoxysilane was changed to isobutyltrimethoxysilane.

The types, Mohs hardness, number average particle diameter and surface modifier of the inorganic particles 1 to 14 are listed in the following Table I. In addition, the silane coupling agent described in Table I is a surface modifier for inorganic particles. X in the structure of the silane coupling agent represents the carbon number of the alkyl group of X in the following Formula (1). R in the structure of the silane coupling agent represents the type of substituent represented by R in the following Formula (1).

$$X—Si(OR)_3 \qquad \text{Formula (1)}$$

(Measuring Method of Number Average Particle Diameter)

The number average particle diameter of the inorganic particles and aliphatic acid metal salt particles described later was measured by the following method.

An SEM image magnified 50,000 times was captured with a scanning electron microscope (SEM) "JSM-7401F" (manufactured by JEOL Ltd.), and the inorganic particles in the SEM image were binarized with an image analyzer LUZEX AP (manufactured by NIRECO CORPORATION). The horizontal Feret diameters of 100 inorganic particles were calculated, and the average was defined as the number average particle diameter.

TABLE I

| Inorganic particles | | Mohs | Number average particle diameter | Surface modifier Structure of silane coupling agent | |
|---|---|---|---|---|---|
| No. | Type | hardness | (nm) | X | R |
| 1 | Alumina | 8 | 15 | 4 | Methyl group |
| 2 | Alumina | 8 | 10 | 4 | Methyl group |
| 3 | Alumina | 8 | 30 | 4 | Methyl group |
| 4 | Alumina | 8 | 50 | 4 | Methyl group |
| 5 | Alumina | 8 | 15 | 8 | Methyl group |
| 6 | Alumina | 8 | 15 | 10 | Methyl group |
| 7 | Alumina | 8 | 15 | 2 | Methyl group |
| 8 | Alumina | 8 | 15 | 1 | Methyl group |
| 9 | Silicon carbide | 9 | 15 | — | — |
| 10 | Alumina | 9 | 15 | 4 | Methyl group |
| 11 | Alumina | 8 | 5 | 4 | Methyl group |

TABLE I-continued

| Inorganic particles | | Mohs | Number average particle diameter | Surface modifier Structure of silane coupling agent | |
|---|---|---|---|---|---|
| No. | Type | hardness | (nm) | X | R |
| 12 | Alumina | 8 | 60 | 4 | Methyl group |
| 13 | Silica | 7 | 15 | 8 | Methyl group |
| 14 | Alumina | 8 | 15 | 4 | Ethyl group |

[Preparation of Aliphatic Acid Metal Salt Particles]

<Preparation of Aliphatic Acid Metal Salt Particles 1>

140 mass parts of stearic acid were added to 1,000 mass parts of ethanol and mixed at 75° C. To this mixture were slowly added 50 mass parts of zinc hydroxide and mixed for 1 hour. Thereafter, the mixture was cooled to 20° C., and the product was taken out and dried at 150° C. to remove ethanol. The obtained solid of zinc stearate was coarsely pulverized with a hammer mill and then finely pulverized with a jet air pulverizer "I-20 JET MILL" (manufactured by Nippon Pneumatic Mfg. Co. Ltd.). The product was classified at a cut point of 1.4 μm by an air classifier "DS-20/DS-10 CLASSIFIER" (manufactured by Nippon Pneumatic Mfg. Co. Ltd.), and aliphatic acid metal salt particles 1 made of zinc stearate (ZnSt) having a number average particle diameter of 1.0 μm were prepared.

<Preparation of Aliphatic Acid Metal Salt Particles 2>

Aliphatic acid metal salt particles 2 made of calcium stearate (CaSt) having a number average particle diameter of 1.0 μm were prepared in the same manner as in the method of preparing the aliphatic acid metal salt particles 1 except that zinc hydroxide was changed to calcium hydroxide.

<Preparation of Aliphatic Acid Metal Salt Particles 3>

Aliphatic acid metal salt particles 3 made of lithium stearate (LiSt) having a number average particle diameter of 1.0 μm were prepared in the same manner as in the method of preparing the aliphatic acid metal salt particles 1 except that zinc hydroxide was changed to lithium hydroxide.

<Preparation of Aliphatic Acid Metal Salt Particles 4>

Aliphatic acid metal salt particles 4 made of zinc stearate (ZnSt) having a number average particle diameter of 2.0 μm were prepared in the same manner as in the method of preparing the aliphatic acid metal salt particles 1 except that the cut point in the classification was changed from 1.9 μm to 2.4 μm.

<Preparation of Aliphatic Acid Metal Salt Particles 5>

Aliphatic acid metal salt particles 5 made of zinc stearate (ZnSt) having a number average particle diameter of 0.4 μm were prepared in the same manner as in the method of preparing the aliphatic acid metal salt particles 1 except that the cut point in the classification was changed from 1.9 μm to 0.6 μm.

<Preparation of Aliphatic Acid Metal Salt Particles 6>

Aliphatic acid metal salt particles 6 made of zinc stearate (ZnSt) having a number average particle diameter of 3.0 μm were prepared in the same manner as in the method of preparing the aliphatic acid metal salt particles 1 except that the cut point in the classification was changed from 1.9 μm to 3.4 μm.

<Preparation of Aliphatic Acid Metal Salt Particles 7>

Aliphatic acid metal salt particles 7 made of zinc stearate (ZnSt) having a number average particle diameter of 0.3 μm were prepared in the same manner as in the method of preparing the aliphatic acid metal salt particles 1 except that the cut point in the classification was changed from 1.9 μm to 0.5 μm.

The types and number average particle diameters of the aliphatic acid metal salt particles 1 to 7 are indicated in the following Table II.

TABLE II

| Aliphatic acid metal salt particles No. | Type | Number average particle diameter (μm) |
|---|---|---|
| 1 | ZnSt | 1.0 |
| 2 | CaSt | 1.0 |
| 3 | LiSt | 1.0 |
| 4 | ZnSt | 2.0 |
| 5 | ZnSt | 0.4 |
| 6 | ZnSt | 3.0 |
| 7 | ZnSt | 0.3 |

[Preparation of Colorant Particle Dispersion Liquid 1]

While stirring a solution of 11.5 mass parts of sodium n-dodecylsulfate dissolved in 160 mass parts of ion-exchanged water, 24.5 mass parts of copper phthalocyanine was gradually added to the solution. Subsequently, dispersion treatment was carried out using a stirring apparatus "CLEARMIX W MOTION CLM-0.8" (manufactured by M Technique Co., Ltd.), whereby a colorant particle dispersion liquid 1 having a volume-based median diameter of 126 nm was obtained.

[Preparation of Styrene-Acrylic Resin Particle Dispersion Liquid 1]

(1) First Stage Polymerization

Into a reaction vessel equipped with a stirrer, a temperature sensor, a cooling tube, and a nitrogen introducing device, 4 mass parts of sodium polyoxyethylene (2) dodecyl ether sulfate and 3,000 mass parts of ion-exchanged water were charged. While stirring at a stirring speed of 230 rpm under a nitrogen flow, the inner temperature of the reaction vessel was raised to 80° C. After raising the temperature, a solution of 10 mass parts of potassium persulfate dissolved in 200 mass parts of ion-exchanged water was added thereto, and the liquid temperature was raised again to 75° C. A mixed solution of the following monomer mixture was added dropwise to this solution over 1 hour.

Styrene: 584 mass parts n-Butyl acrylate: 160 mass parts

Methacrylic acid: 56 mass parts

After dropping the monomer mixture, the reaction system was heated and stirred at 75° C. for 2 hours to carry out the polymerization. Thus, a dispersion liquid of resin particles [1] was prepared.

(2) Second Stage Polymerization

Into a reaction vessel equipped with a stirrer, a temperature sensor, a cooling tube, and a nitrogen introducing device, a solution of 2.0 mass parts of sodium polyoxyethylene (2) dodecyl ether sulfate dissolved in 3,000 mass parts of ion-exchanged water was charged. The solution was heated to 80° C. Then, 42 mass parts (in terms of solid content) of the resin particles [1] prepared by the first stage polymerization, and 70 mass parts of microcrystalline "HNP-019" (produced by Nippon Seiro Co. Ltd) dissolved in the following monomer solution at 80° C. and this solution were added to the reaction vessel.

Styrene: 239 mass parts n-Butyl acrylate: 111 mass parts

Methacrylic acid: 26 mass parts n-Octyl mercaptan: 3 mass parts

The reaction system was mixed and dispersed for 1 hour by using a mechanical disperser with a circulation route "CLEARMIX" (manufactured by M Technique Co. Ltd.) so that a dispersion liquid containing emulsion particles (oil particles) was prepared. Then, an initiator solution of 5 mass parts of potassium persulfate dissolved in 100 mass parts of ion-exchanged water was added to the dispersion liquid, and the system was heated and stirred at 80° C. for 1 hour to carry out polymerization. Thereby a dispersion liquid of resin particles [2] was prepared.

(3) Third Stage Polymerization

To the dispersion liquid of resin particles [2] as described above was added a solution of 10 mass parts of potassium persulfate dissolved in 200 mass parts of ion-exchanged water. The following monomer mixture solution was added to this at a temperature condition of 80° C. over 1 hour.

Styrene: 380 mass parts
n-Butyl acrylate: 132 mass parts
Methacrylic acid: 39 mass parts
n-Octyl mercaptan: 6 mass parts After completion of the dropwise addition, polymerization was carried out by heating and stirring for 2 hours, followed by cooling to 28° C., whereby a binder resin particle dispersion liquid 1 was obtained.

[Preparation of Crystalline Resin Particle Dispersion Liquid 1]

<Synthesis of Crystalline Resin Particles 1>

Into a reaction vessel equipped with a nitrogen introduction tube, a dehydration tube, a stirrer and a thermocouple were placed 220 mass parts of sebacic acid (molecular weight of 202.25) of polycarboxylic acid compound and 298 mass parts of 1,12-dodecanediol (molecular weight 202.33) of polyhydric alcohol compound as materials of polyester polymerization segment, and the mixture was heated at 160° C. to be dissolved. Thereafter, 2.5 mass parts of tin (II) 2-ethylhexanoate and 0.2 mass parts of gallic acid were added, the temperature was raised to 210° C., and the reaction was carried out for 8 hours. The reaction was further carried out at 8.3 kPa for 1 hour to obtain a crystalline resin 1. A DSC curve was obtained using the differential scanning calorimeter "DIAMOND DSC" (manufactured by PerkinElmer Co. Ltd.) at a heating rate of 10° C. for the resulting crystalline resin 1. The measurement result of the melting point (Tm) by the method of measuring the endothermic peak top temperature was 82.8° C. As a result of measuring the molecular weight by GPC "HLC-8120 GPC" (manufactured by Tosoh Corporation), the standard styrene-equivalent weight average molecular weight Mw was 28,000.

<Preparation of Crystalline Resin Particle Dispersion Liquid 1>

100 mass parts of the crystalline resin 1 were dissolved in 400 mass parts of ethyl acetate. Next, 25 mass parts of a 5.0 mass % sodium hydroxide aqueous solution was added to prepare a resin solution. This resin solution was charged into a container having a stirring device, and while stirring the resin solution, 638 mass parts of a 0.26 mass % sodium lauryl sulfate aqueous solution were dropped and mixed over 30 minutes. During the dropwise addition of the sodium lauryl sulfate aqueous solution, the liquid in the reaction vessel became turbid. Further, after the entire amount of sodium lauryl sulfate aqueous solution was dropped, an emulsified liquid was prepared in which the resin solution particles were uniformly dispersed. Subsequently, the emulsion was heated to 40° C., and ethyl acetate was distilled off under a reduced pressure of 150 hPa using a diaphragm type vacuum pump "V-700" (manufactured by BUCHI Co. Ltd.). Thereby a crystalline resin particle dispersion liquid 1 made of a crystalline polyester resin was obtained.

[Production of Toner Mother Particles 1]

(Aggregation-Fusion Process)

Into a reaction vessel equipped with a stirrer, a temperature sensor, a cooling tube and a nitrogen introduction device, the following ingredients were placed: 300 mass parts (in terms of solid content) of the binder resin particle dispersion liquid 1, 60 mass parts (in terms of solid content) of the crystalline resin particle dispersion liquid 1, 1100 mass parts of ion-exchanged water, and 40 mass parts (in terms of solid content) of the colorant particle dispersion liquid 1. After adjusting the liquid temperature to 30° C., the pH was adjusted to 10 by adding 5 N sodium hydroxide aqueous solution. Next, an aqueous solution in which 60 mass parts of magnesium chloride were dissolved in 60 mass parts of ion-exchanged water was added under stirring at 30° C. over 10 minutes. After keeping the temperature for 3 minutes, the system was heated to 85° C. over 60 minutes, while maintaining the temperature of 85° C., the particles were aggregated and the particle growth reaction was continued. The particle size of the aggregated particles was measured by using a "COULTER MULTISIZER 3" (Beckman Coulter Inc.)". When the average particle size reached 6.5 μm, an aqueous solution of 40 mass parts of sodium chloride dissolved in 160 mass parts of ion-exchanged water was added to terminate the particle growth. Further, as an aging step, heating and stirring were carried out at a liquid temperature of 80° C. for 1 hour to progress the fusion between the particles, whereby a dispersion liquid of the toner mother particles 1 was prepared.

(Cleaning-Drying Process)

The resulting dispersion liquid of the toner mother particles 1 was subjected to solid-liquid separation with a basket type centrifuge "MARK III type number 60×40+M" (manufactured by Matsumoto Machinery Manufacturing Co., Ltd.) to form a wet cake of toner mother particles 1. The obtained wet cake was washed with ion-exchanged water at 40° C. with the same basket type centrifuge until the electric conductivity of the filtrate reached 5 μS/cm. Thereafter, it was transferred to a flash jet dryer (manufactured by Seishin Enterprise Co. Ltd.) and dried until the water content reached 0.5 mass %. Thereby toner mother particles were prepared.

The content of the crystalline resin in the toner mother particles 1 obtained by the above method is 15 mass %, and this value can be calculated by the following formula. The mass of each material is a value converted to a solid content.

Content (mass %) of crystalline resin in toner mother particles=amount of crystalline resin/(amount of styrene acrylic resin+amount of crystalline resin+amount of colorant)×100.

Similarly, the content (mass %) of styrene acrylic resin is calculated by the following formula. The mass of each material is a value converted to a solid content.

Content (mass %) of styrene-acrylic resin in toner mother particles=amount of styrene-acrylic resin/(amount of styrene-acrylic resin+amount of crystalline resin+amount of colorant)×100

For example, in the case of the toner mother particles 1, the crystalline resin content is calculated as follows.

$$60/(300+60+40)\times 100=15\%$$

The content of styrene-acrylic resin is calculated as follows.

$$300/(300+60+40)\times 100=75\%$$

[Preparation of Toner]

<Preparation of Toner 1>

To the "toner mother particles 1" prepared as described above were added the following.

Silica particles 1 (HMDS treated, number average primary particle diameter=110 nm): 0.4 mass %

Inorganic particles 1: 2.0 mass %

Aliphatic acid metal salt particles 1: 0.2 mass %

Then, the mixture was placed in a Henschel mixcr HENSCHEL MIXER model "FM 20C/I" (manufactured by Nippon Coke & Engineering Co. Ltd.) with setting the rotation number so that the blade tip circumferential speed was 50 m/s, and stirred for 20 minutes to obtain a "toner 1" containing the toner mother particles 1.

Further, the temperature at the time of mixing external additives was set to be 40° C.±1° C. When the temperature became 41° C., cooling water was flowed into the outer bath of the HENSCHEL MIXER at a flow rate of 5 L/min, and when the temperature became 39° C., the cooling water was flowed at a flow rate of 1 L/min. Thus, temperature control inside the HENSCHEL MIXER was carried out.

<Preparation of Toners 2 to 20>

Toners 2 to 20 were prepared in the same manner as in the method of preparing the toner 1 except that the types of inorganic particles and aliphatic acid metal salt particles to be added were changed as described in the following Table III.

[Preparation of Carrier Particles]

(Preparation of Carrier Core Material Particles 1)

The raw materials were weighed so that MnO: 35 mol %, MgO: 14.5 mol %, $Fe_2O_3$: 50 mol % and SrO: 0.5 mol %. After mixing the raw materials with water, the mixture was pulverized with a wet media mill to obtain a slurry. The obtained slurry was dried with a spray drier to obtain spherical particles. After controlling the particle size of these particles, they were heated at 950° C. for 2 hours to perform pre-baking. After grinding with a wet ball mill using stainless steel beads having a diameter of 0.3 cm for 1 hour, the mixture was pulverized for 4 hours using zirconia beads having a diameter of 0.5 cm. PVA as a binder was added in an amount of 0.8 mass % based on the solid content. Then, granulation and drying were carried out with a spray dryer, and the resultant mixture was maintained at a temperature of 1350° C. for 5 hours in an electric furnace, and main calcination was carried out. Thereafter, it was disintegrated, further classified to adjust the particle size, and further, the low magnetic force products were separated by magnetic power separation to obtain carrier core material particles 1. The particle diameter of the carrier core material particles 1 was 35 μm.

(Preparation of Core Material Coating Resin 1)

Into an aqueous solution of sodium benzenesulfonate of 0.3 mass % were added cyclohexyl methacrylate and methyl methacrylate having a mass ratio of 5:5 (copolymerization ratio). Potassium persulfate in an amount corresponding to 0.5 mass % of the total amount of monomers was added, and emulsion polymerization was carried out. Thereafter, drying was performed by spray drying to prepare a "coating material 1". The weight average molecular weight of the coating material 1 thus obtained was 500,000.

(Preparation of Carrier Particles 1)

100 mass parts of the "carrier core material particles 1" prepared above as core material particles and 4.5 mass parts of the "coating material 1" were placed in a high-speed stirring mixer equipped with horizontal stirring blades, and the peripheral speed of the horizontal rotating blade was set to 8 m/sec, and the mixture was stirred at 22° C. for 15 minutes. After that, the mixture was mixed at 120° C. for 50 minutes, and the coating material was coated on the surface of the core material particles by the action of mechanical impact force (mechano-chemical method) to produce "carrier particles 1".

[Preparation of Developer]

<Preparation of Developer 1>

The toner 1 and the carrier particle 1 as described above were mixed so that the toner concentration was 6.5 mass % to prepare a "developer 1". The mixing was done for 30 minutes by using a V-type mixer. The following evaluations were carried out.

<Preparation of Developers 2 to 20>

Developers 2 to 20 were prepared in the same manner as in the method of preparing the developer 1 except that the toner 1 was changed to the toners 2 to 20 as described in Table III.

<Evaluation Methods>

(1) Evaluation of Image Density Difference

The above-described developers and toners were mounted on a developing device of a commercially available color multi-functional peripheral (MFP) "BIZHUB C658" (manufactured by Konica Minolta Inc.). At the normal temperature and normal humidity environment (temperature 20° C., humidity 50% RH), as a test image on A4 size high-quality paper (65 g/m$^2$), 1000 sheets of images were continuously printed in which the right half was a solid image (image part) and the left half was a white part (non-image part) when the printing was vertically divided into 2 parts. Thereafter, an image in which the entire surface was halftone was output, and the density at 5 portions corresponding to the image part (right half) and 5 portions corresponding to the non-image part (left half) at the time of printing 1000 sheets were compared by measuring with a Macbeth reflection densitometer "RD907" (manufactured by Macbeth Co.). Then, the maximum image density difference was calculated by the following equation.

Maximum image density difference="Image density at the point having the highest image density among the image densities of the 5 portions corresponding to the band portion in the durability test"−"Image density of a portion corresponding to a non-band portion"

Then, when the calculated maximum image density difference was 0.10 or less, it was judged to be acceptable for practical use and to pass the examination. Here, the image density is an absolute density.

(2) Evaluation of Cleaning Property of Photoreceptor

A commercially available color multi-functional peripheral (MFP) "BIZHUB C658" (manufactured by Konica Minolta Inc.) was used. At a predetermined temperature and humidity environment (temperature 30° C., humidity 80% RH), as a test image on A4 size high-quality paper (65 g/m$^2$), 10,000 sheets of images were continuously printed in which vertical bands with a coverage rate of 25% were printed. After that, a solid image was output on the whole surface, and the streaks which were white and escaped in the printing direction were visually counted. Evaluation was judged to be acceptable for practical use when the number of streaks was 10 or less.

TABLE III

| Toner No./ Developer No. | Inorganic particles No. | Aliphatic acid metal salt particles No. | Evaluation of image density difference Image density difference | Evaluation of cleaning property Number of streaks (pieces) | Remarks |
|---|---|---|---|---|---|
| 1 | 1 | 1 | 0.04 | 2 | *1 |
| 2 | 2 | 1 | 0.10 | 2 | *1 |
| 3 | 3 | 1 | 0.05 | 1 | *1 |
| 4 | 4 | 1 | 0.09 | 0 | *1 |
| 5 | 5 | 1 | 0.05 | 6 | *1 |
| 6 | 6 | 1 | 0.07 | 8 | *1 |
| 7 | 7 | 1 | 0.04 | 4 | *1 |
| 8 | 8 | 1 | 0.04 | 5 | *1 |
| 9 | 1 | 2 | 0.05 | 6 | *1 |
| 10 | 1 | 3 | 0.05 | 6 | *1 |
| 11 | 1 | 4 | 0.09 | 3 | *1 |
| 12 | 1 | 5 | 0.03 | 10 | *1 |
| 13 | 9 | 1 | 0.04 | 8 | *1 |
| 14 | 10 | 1 | 0.04 | 2 | *1 |
| 15 | 14 | 1 | 0.05 | 2 | *1 |
| 16 | 11 | 1 | 0.11 | 2 | *2 |
| 17 | 12 | 1 | 0.12 | 0 | *2 |
| 18 | 1 | 6 | 0.12 | 2 | *2 |
| 19 | 1 | 7 | 0.02 | 11 | *2 |
| 20 | 13 | 1 | 0.11 | 2 | *2 |

*1: Present invention
*2: Comparative example

CONCLUSION

From the above-described evaluation result table it was demonstrated that the toner of the present invention is less likely to cause a difference in image density, and is excellent in the cleaning performance of the photoreceptor when an electrophotographic image using the electrostatic latent image developing toner was formed. On the other hand, the toner of the comparative example was inferior to the toner of the present invention in at least one of above-described evaluation items.

What is claimed is:

1. An electrostatic latent image developing toner comprising toner mother particles having an external additive on a surface of the toner mother particles, wherein the external additive consists of first inorganic particles, aliphatic acid metal salt particles, and optionally other inorganic particles;

the first inorganic particles have a number average particle diameter in the range of 10 to 50 nm, and have a Mohs hardness of 8 or more;

the aliphatic acid metal salt particles have a number average particle diameter in the range of 0.4 to 2.0 μm;

the first inorganic particles are surface-modified with a silane coupling agent, and the silane coupling agent has a structure represented by Formula (1), $$X—Si(OR)_3 \qquad \text{Formula (1)}$$

wherein X represents an alkyl group having 2 to 8 carbon atoms, and R represents a methyl group or an ethyl group.

2. The electrostatic latent image developing toner described in claim 1, wherein the first inorganic particles are alumina particles.

3. The electrostatic latent image developing toner described in claim 1, wherein the aliphatic acid metal salt particles are at least one selected from the group consisting of zinc stearate particles, lithium stearate particles, and calcium stearate particles.

4. The electrostatic latent image developing toner described in claim 1, wherein the aliphatic acid metal salt particles are zinc stearate particles.

5. The electrostatic latent image developing toner described in claim 1, wherein the first inorganic particles have a number average particle diameter in the range of 10 to 30 nm.

6. An image forming method using the electrostatic latent image developing toner described in claim 1, comprising:

charging a surface of a photoreceptor with a charging roller which is provided so as to contact the photoreceptor;

imagewise exposing to light the charged photoreceptor to form an electrostatic latent image;

developing the latent image with the toner described in claim 1; and transferring the toner image to a substrate.

* * * * *